US009797698B2

(12) United States Patent
Adams et al.

(10) Patent No.: US 9,797,698 B2
(45) Date of Patent: Oct. 24, 2017

(54) COMMON CARRIER MUNITION

(71) Applicant: BAE SYSTEMS plc, London (GB)

(72) Inventors: Daniel Alexander Adams, Monmouthshire (GB); Matthew Jones, Monmouthshire (GB); Andy Oden Burn, Monmouthshire (GB); David John Costin, Monmouthshire (GB); Stuart Andrew McCombie, Monmouthshire (GB); John Wainwright, Monmouthshire (GB); Michael Shaun Rumfitt, Monmouthshire (GB)

(73) Assignee: BAE SYSTEMS plc, London (GB)

( * ) Notice: Subject to any disclaimer, the term of this patent is extended or adjusted under 35 U.S.C. 154(b) by 0 days.

(21) Appl. No.: 14/913,088

(22) PCT Filed: Aug. 18, 2014

(86) PCT No.: PCT/GB2014/052526
§ 371 (c)(1),
(2) Date: Feb. 19, 2016

(87) PCT Pub. No.: WO2015/025141
PCT Pub. Date: Feb. 26, 2015

(65) Prior Publication Data

US 2016/0209191 A1 Jul. 21, 2016

(30) Foreign Application Priority Data

Aug. 20, 2013 (EP) ..... 13275188
Aug. 20, 2013 (GB) ..... 1314869.7

(51) Int. Cl.
*F42B 12/62* (2006.01)
*F42B 12/42* (2006.01)

(52) U.S. Cl.
CPC ..... *F42B 12/625* (2013.01); *F42B 12/42* (2013.01)

(58) Field of Classification Search
CPC ..... F42B 12/625; F42B 12/58; F42B 12/62; F42B 12/60
(Continued)

(56) References Cited

U.S. PATENT DOCUMENTS 2,421,859 A * 6/1947 Whitney ..... F42C 9/141 102/268
2,943,572 A * 7/1960 Flett ..... F42C 13/02 102/214
(Continued)

FOREIGN PATENT DOCUMENTS

DE 1913790 A1 10/1970
DE 3206497 A1 11/1982
(Continued)

OTHER PUBLICATIONS

International Search Report and Written Opinion received for Patent Application No. PCT/GB2014/052526, mailed on Sep. 17, 2014. 11 pages.
(Continued)

*Primary Examiner* — Joshua Freeman
(74) *Attorney, Agent, or Firm* — Finch & Maloney PLLC

(57) ABSTRACT

The invention relates to a common carrier munition ammunition device, more particularly to common carrier payload delivery shell.

There is provided a common carrier munition comprising a tail unit, a main body which comprises a payload cavity for receiving a payload, a fuze, and located between said main body and the fuze an ogive element, wherein the tail unit and
(Continued)

main body comprise cooperatively engaging male and female threaded portions, wherein at least one of the threads is a shearable thread.

19 Claims, 1 Drawing Sheet

(58) Field of Classification Search
USPC ..... 102/499
See application file for complete search history.

(56) References Cited

U.S. PATENT DOCUMENTS 3,055,300 A * 9/1962 Stoehr ..... F42B 4/12 102/339
3,677,182 A * 7/1972 Peterson ..... F42B 12/62 102/364
3,750,575 A 8/1973 Heede et al.
3,834,312 A * 9/1974 Simmons ..... F42B 10/56 102/339
3,842,741 A 10/1974 Brothers et al.
3,981,244 A * 9/1976 Adimari ..... F42B 12/62 102/489
4,226,185 A * 10/1980 Tobler ..... F42B 10/56 102/340
4,557,198 A * 12/1985 Hickey ..... F42B 12/58 102/481
4,651,648 A * 3/1987 Alon ..... F42B 10/56 102/334
4,771,696 A * 9/1988 Smolnik ..... F42B 30/003 102/293
4,793,260 A * 12/1988 Kruse ..... F42B 12/62 102/357
4,807,533 A * 2/1989 von Entress-Fursteneck ..... F42B 12/62 102/476
4,833,993 A 5/1989 Garcia-Garcia
4,860,659 A * 8/1989 Andreetta ..... F42B 30/08 102/473
H959 H * 9/1991 Heckman ..... F42B 12/625 102/357
5,107,768 A * 4/1992 Langenohl ..... F42B 30/08 102/293
5,210,372 A * 5/1993 Tripptrap ..... F42B 12/62 102/357
5,233,127 A * 8/1993 Sauvestre ..... F42B 12/62 102/357
5,317,975 A * 6/1994 Sauvestre ..... F42B 12/62 102/357
5,347,931 A * 9/1994 Day ..... F42B 12/42 102/275.6
5,386,781 A * 2/1995 Day ..... F42B 4/28 102/337
5,454,324 A * 10/1995 Larmignat ..... F42B 5/155 102/334
5,684,267 A * 11/1997 Dean ..... F42B 12/62 102/293
5,792,981 A * 8/1998 Singer ..... F02K 9/343 102/381
6,523,478 B1 2/2003 Gonzalez et al.
6,679,177 B1 * 1/2004 Wu ..... F42B 15/36 102/377
6,782,829 B1 * 8/2004 Han ..... F42B 10/56 102/387
6,860,185 B2 * 3/2005 Altenau ..... F42B 12/204 86/51
6,981,450 B1 * 1/2006 Adimari ..... F42B 12/60 102/393
7,121,210 B2 * 10/2006 Steele ..... F42B 12/58 102/211
7,124,690 B1 10/2006 Tadros et al.
7,360,489 B1 4/2008 Han et al.
8,601,950 B2 * 12/2013 Dau ..... F42B 12/207 102/473
2002/0166475 A1 11/2002 Brooks et al.
2003/0116051 A1 6/2003 Kravel et al.
2003/0205161 A1 * 11/2003 Roach ..... F42B 39/20 102/481
2004/0107860 A1 * 6/2004 Loubser ..... F42B 12/62 102/481
2004/0134372 A1 * 7/2004 Scherer ..... F42B 12/48 102/499
2005/0066842 A1 3/2005 Brunn et al.
2005/0223930 A1 10/2005 Bootes et al.
2007/0006767 A1 * 1/2007 Brislin ..... F42B 12/64 102/489
2009/0151590 A1 6/2009 Dau et al.
2011/0079164 A1 4/2011 Broden et al.
2012/0044710 A1 2/2012 Jones
2012/0180686 A1 7/2012 Jones et al.
2013/0055917 A1 3/2013 Menefee, III
2013/0186295 A1 7/2013 Kravel
2013/0239838 A1 9/2013 Kravel
2013/0319278 A1 12/2013 Kravel
2014/0013985 A1 1/2014 Kravel
2016/0202031 A1 * 7/2016 Rumfitt ..... F42B 12/64 102/334
2016/0209189 A1 7/2016 Adams
2016/0209190 A1 * 7/2016 Jones ..... F42B 12/625
2016/0209191 A1 * 7/2016 Adams ..... F42B 12/625

FOREIGN PATENT DOCUMENTS

DE 3339039 A1 5/1985
DE 102007048074 A1 4/2009
EP 0466499 A1 1/1992
FR 1398715 A 5/1965
FR 2697328 A1 4/1994
FR 2699659 A1 6/1994
GB 143281 5/1920
GB 1179804 A 2/1970
GB 1415274 11/1975
GB 2105813 A 3/1983
GB 2274905 A 8/1994
JP 2011047527 A 3/2011
WO 2015025141 A1 2/2015
WO 2015025143 A1 2/2015
WO 2015025144 A1 2/2015
WO 2015025145 A1 2/2015

OTHER PUBLICATIONS

GB Intellectual Property Office Search Report under Section 17(5) received for GB Patent Application No. 1314869.7 mailed Dec. 13, 2013. 6 pages.
Extended European Search Report received for EP Patent Application No. 13275188.4 mailed Feb. 4, 2014. 7 pages.
GB Intellectual Property Office Search Report under Section 17(6) received for GB Patent Application No. 1314869.7 (as it relates to claim 14) mailed Jun. 13, 2014. 3 pages.
International Preliminary Report on Patentability received for Patent Application No. PCT/GB2014/052526, mailed on Mar. 3, 2016. 7 pages.
International Search Report and Written Opinion received for Patent Application No. PCT/GB2014/052530, mailed on Sep. 17, 2014. 11 pages.
GB Intellectual Property Office Search Report under Section 17(5) received for GB Patent Application No. 1314865.5 mailed Dec. 20, 2013. 4 pages.
Extended European Search Report received for EP Patent Application No. 13275187.6 mailed Jan. 29, 2014. 5 pages.
International Search Report and Written Opinion received for Patent Application No. PCT/GB2014/052528, mailed on Sep. 17, 2014. 11 pages.
GB Intellectual Property Office Search Report under Section 17(5) received for GB Patent Application No. 1314868.9 mailed Dec. 20, 2013. 4 pages.

(56) References Cited

OTHER PUBLICATIONS

Extended European Search Report received for EP Patent Application No. 13275190.0 mailed Jan. 31, 2014. 7 pages.
International Search Report and Written Opinion received for Patent Application No. PCT/GB2014/052529, mailed on Sep. 17, 2014. 11 pages.
GB Intellectual Property Office Search Report under Section 17(5) received for GB Patent Application No. 1314867.1 mailed Dec. 20, 2013. 4 pages.
Extended European Search Report received for EP Patent Application No. 13275189.2 mailed Feb. 7, 2014. 6 pages.
International Preliminary Report on Patentability received for Patent Application No. PCT/GB2014/052528, mailed on Mar. 3, 2016. 7 pages.
International Preliminary Report on Patentability received for Patent Application No. PCT/GB2014/052529 mailed on Mar. 3, 2016. 7 pages.
International Preliminary Report on Patentability received for Patent Application No. PCT/GB2014/052530 mailed on Mar. 3, 2016. 7 pages.

* cited by examiner

COMMON CARRIER MUNITION

The invention relates to a common carrier munition device, more particularly to common carrier payload delivery shell.

There are many types of munitions that are deployed from ordnance during engagement, with a variety of payloads including high explosives, illumination, smokes, decoys, UAVs etc.

According to a first aspect of the invention there is provided a common carrier munition comprising a tail unit, a main body which comprises a payload cavity for receiving a payload, a fuze, and located between said main body and the fuze an ogive element, wherein the tail unit and main body comprise cooperatively engaging male and female threaded portions, wherein at least one of the threads is a shearable thread.

The shearable thread allows the payload to be reversibly loaded from the aft of the main body. Prior art shells are fitted with shearable pins, which irreversibly secure the tail unit to the main body, such that once the munition is constructed the tail unit may only be removed by action of the device or by applying substantial force, to cause shearing of the pins. The use of a shearable thread allows the tail unit to be readily fitted and removed without damaging the shearable linkage. It is therefore possible to remove the payload for routine disposal.

The main body threaded portion may be manufactured from a first material, and the tail unit threaded portion may be manufactured from second material, wherein the second material has a lower hardness value than the first material, such that upon an applied force, such as, for example the pressure of the gas generated from the expulsion charge, the lower hardness material readily undergoes plastic deformation such that the tail unit disengages from the main body.

In a highly preferred arrangement the first material is selected from a steel alloy and the second material is selected from aluminium or alloy thereof. For gun launched munitions, such as for examples shells, the forces experienced during launch will place the shell under uniform compression, however the initiation of the expulsion charge, via action of the fuze, will cause the internal cavity of the shell and hence the force on the payload, to place the tail unit under a tensile load, forcing said tail unit and steel body in opposing directions.

The payload may be inserted into the payload cavity from the aft end of the munition. The payload may be slidably engaged with the payload cavity, such as for example it may have an engineering fit with payload cavity, such that the payload may be prevented from moving within a direction which is normal to the elongate axis of the munition. The payload cavity may have substantially parallel walls, which extend from the intersection of main body and tail unit up to a locking ring. To prevent movement of the payload within the cavity along the elongate axis of the munition, the locking ring may be located between the main body and said ogive element, to retain said payload within the payload cavity and prevent movement. Preferably the locking ring and main body comprise cooperatively engaging threaded portions, to allow reversible locking engagement. This allows the locking ring to compensate for any tolerances in manufacture of the payload, and to ensure that the payload is retained in position.

The payload may be any commonly used payload such as, for example high explosives, illumination, smokes, decoys, chaff or a UAV. The payload and payload cavity are selected such that they are preferably of a uniform dimension, such that any payload may be readily inserted into the uniform payload cavity of the munition. In a preferred arrangement the payload is a modular unit. This allows flexibility on logistics, such that any payload may be inserted into any available carrier munition or shell. Conventional smoke and illumination payloads have bespoke shells or munitions and there is no interchangeability between munitions.

In a preferred arrangement the payload is reversibly loadable from the aft end of the main body. The provision of a threaded tail unit allows the payload to be loaded and removed from the aft end. In a highly preferred arrangement during use the payload is capable of being dispensed rearwardly from the main body, upon shearing the shearable thread.

The ogive element is a portion of the munition, typically shell body, and may be reversibly engaged with the fuze and main body.

The ogive element may have a forward end locatable with said fuze and an aft end locatable with said main body, wherein the internal diameter of the aft end of said ogive element may be substantially the same as the internal diameter of said payload cavity.

The fuze may be operably connected to an explosive train, to provide an energetic output, such as an expulsion charge or detonative output. Where the payload is delivered during flight i.e. rather than a terminal effect, the payload may be expelled from the munition by an expulsion charge. In preferred arrangement said expulsion charge is suspended in free space within the ogive element, such that it does not physically contact the payload; this allows for minor errors in manufacturing tolerances between the expulsion charge and the payload. The fuze device may comprise safety and arming units (SAU), explosive trains to provide sufficient stimuli to the expulsion charge.

The fuze may be any known fuze, such as those that respond to selected input or stimuli or a combination of inputs, such as, for example, mechanical actions of the projectile, such as the action of high g forces from gun launch or high spin rates from imparted spin, timed delay, either mechanical or pyrotechnic, caused by separation from the launch system, or proximity to a target. The fuze may function due to electronic activation, such as, for example, from an input from a sensor or detector from on-board said munition or external to the munition. On-board systems may be internal guidance systems. External stimuli may be provided such as, for example, by fly-by wire, remote control, GPS or target activated laser guidance.

According to a further aspect of the invention there is provided a method of dispensing a payload from a munition defined herein, comprising the steps of causing initiation of the expulsion charge, and causing shearing of the shearable thread.

According to a further aspect of the invention there is provided a common carrier shell comprising a uniform payload cavity for receiving a uniform payload, wherein said payload may be selected from a smoke, illumination or UAV payload. The uniform payload cavity has a fixed uniform volume, such that it may receive a fixed uniform volume payload. Thus allowing for one carrier shell with a variety of interchangeable payloads.

Whilst the invention has been described above, it extends to any inventive combination of the features set out above, or in the following description, drawings or claims.

Exemplary embodiments of the device in accordance with the invention will now be described with reference to the accompanying drawings in which.

Figure 1:
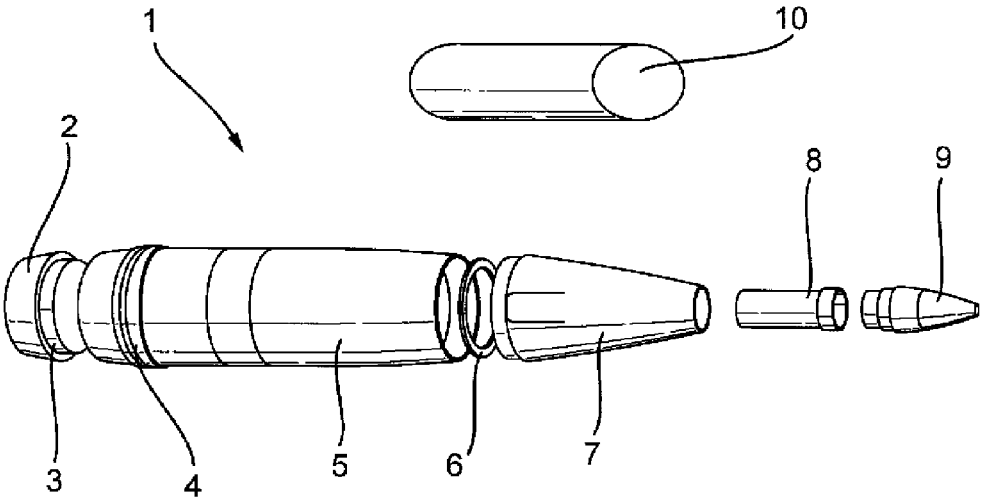
FIG. 1 show an exploded side view of a shell according to the invention.

Turning to FIG. 1 there is provided a shell 1, with a main body 5, which is manufactured from a steel alloy. Located around the circumference of the main body 5 is a copper driving band 4, which allows engagement with the rifling on the bore of a barrel, so as to impart spin. A tail unit 2 is located at the aft of the main body 5. The tail unit 2 is made from aluminium and contains a male threaded portion 3, which engages with a reciprocal female threaded portion (not shown) located in the aft of the main body 5. The payload 10 (shown external to the shell 1), when located in the payload cavity (not shown), inside the main body, is retained in place by use of a locking ring 6, which screws into the forward end of main body 5. The ogive element 7 is removable and is fastened to the locking ring 6. The ogive element receives the expulsion charge 8 and fuze 9. Upon operation of the fuze 9, the expulsion charge 8 builds up pressure within the ogive element and at the bursting pressure the thread 3 shears and the payload 10 is expelled from the aft of the main body 5. The payload 10 is of uniform dimension may be deliver a smoke, illumination, UAV etc output.

Figure 2:
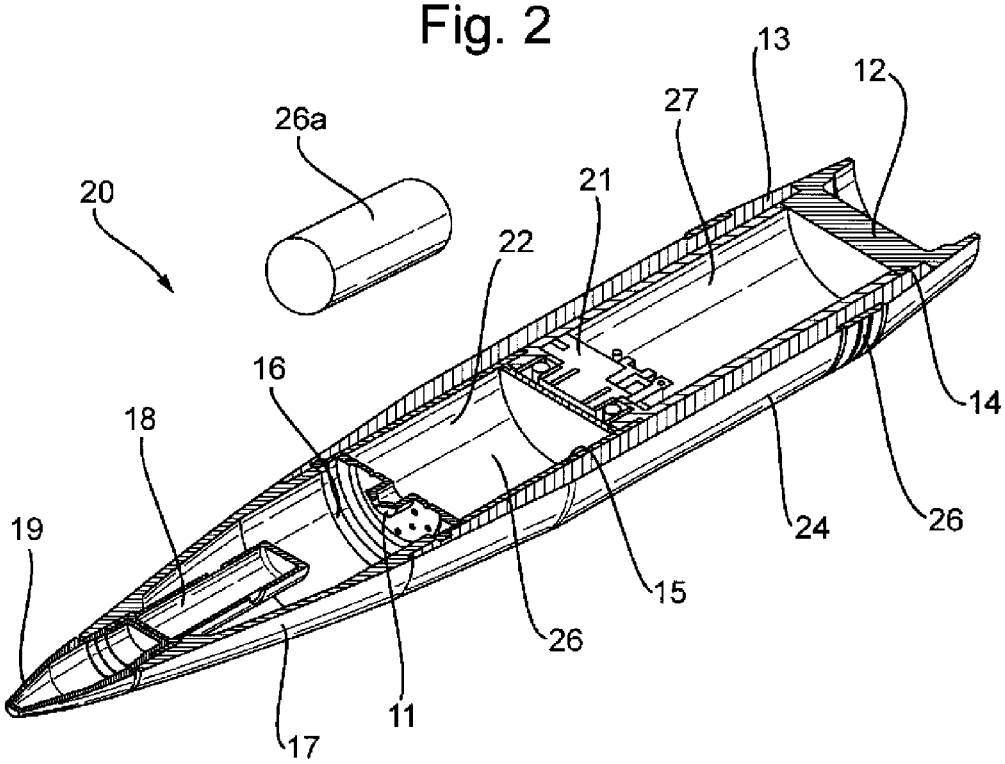
FIG. 2 shows a cross section along the axis of the shell in FIG. 1.

FIG. 2 shows an illumination shell 20, with a main body 24 formed from a steel alloy, with a driving band 26 located thereupon. A tail unit 12 is located at the aft of the main body 24. The tail unit 12 is made from aluminium and contains a male threaded portion 13, which engages with a reciprocal female threaded portion 14 located at the aft of the main body 24.

The payload 22 is located in the payload cavity 15, and is retained in place by use of a locking ring 16, which screws into the forward end of main body 24.

The ogive element 17 is removable and is fastened to the locking ring 16. The ogive element receives the expulsion charge 18 and fuze 19. Upon operation of the fuze 19, the expulsion charge 18 builds up pressure within the ogive element and at the bursting pressure the thread 13 shears and the payload 22 is expelled from the aft of the main body 24.

The payload 22, is a modular illumination unit, which slides into the payload cavity 15. The illumination unit contains a parachute bay 27 which houses a parachute (not shown) and an energetic material bay 26, which houses an energetic material 26*a*.

Upon operation of the fuze 19, the expulsion charge 18 builds up pressure within the ogive element 17 and at the bursting pressure the thread 13 shears and the payload 22 is expelled from the aft of the main body 24. The expulsion charge may cause a delay composition 11 to ignite the energetic material 25.

The invention claimed is:

1. A common carrier munition comprising a tail unit, a main body which comprises a payload cavity for receiving a payload, a fuze, and located between said main body and the fuze an ogive element, wherein the tail unit and main body comprise cooperatively engaging male and female threaded portions, wherein at least one of the threads is a shearable thread, wherein the ogive element is reversibly engaged with the fuze and main body, and a frangible link that retains the ogive element and main body in operable arrangement, such that upon an impact, said frangible link is caused to fail, and such that said shearable thread has a lower shear strength than the frangible link to allow for the shearable thread to fail during flight of the common carrier munition.

2. The munition according to claim 1, wherein the main body comprises a threaded portion manufactured from a first material, and the tail unit comprises a threaded portion manufactured from second material, wherein the second material has a lower hardness value than the first material.

3. The munition according to claim 2, wherein the first material is selected from a steel alloy and the second material is selected from aluminium or alloy thereof.

4. The munition according to claim 1, wherein there is a locking ring located between the main body and said ogive element, to retain said payload within the payload cavity.

5. The munition according to claim 4, wherein the locking ring and main body comprise cooperatively engaging threaded portions.

6. The munition according to claim 1, wherein the ogive element has a forward end locatable with said fuze and an aft end locatable with said main body, wherein the internal diameter of the aft end of said ogive element is substantially the same as the internal diameter of said payload cavity.

7. The munition according to claim 1, wherein the fuze is operably connected to at least one expulsion charge, wherein said charge is suspended in free space.

8. The munition according to claim 1, wherein the payload cavity has substantially parallel walls, which extend from the intersection of the tail unit to the locking ring.

9. The munition according to claim 1, wherein the payload is a modular unit.

10. The munition according to claim 9, wherein the modular unit, is reversibly loadable from the aft end of the main body.

11. The munition according to claim 1, wherein the payload is capable of being dispensed rearwardly from the main body, upon shearing the shearable thread.

12. A method of dispensing a payload from a munition according to claim 1, comprising causing initiation of an expulsion charge, and causing shearing of the shearable thread, wherein the fuze is operably connected to the expulsion charge.

13. A common carrier shell comprising a tail unit, a main body which comprises a payload cavity for receiving a uniform payload, a fuze, and located between said main body and the fuze an ogive element, wherein the ogive element is reversibly engaged with the fuze and main body, wherein said payload is selected from a smoke, illumination or UAV payload, and a frangible link that retains the ogive element and main body in operable arrangement, such that upon an impact, said frangible link is caused to fail, and such that said shearable thread has a lower shear strength than the frangible link to allow for the shearable thread to fail during flight of the common carrier munition.

14. The common carrier shell according to claim 13, wherein the uniform payload cavity has a fixed uniform volume, such that it may receive a fixed uniform volume payload, thereby allowing the carrier shell to be configured with a variety of interchangeable payloads.

15. A common carrier shell comprising:

a tail unit;

a main body including a uniform payload cavity for receiving a modular payload, wherein the payload is selected from a smoke, illumination or UAV payload;

a fuze;

an ogive element located between the main body and the fuze, wherein the tail unit and main body comprise cooperatively engaging threaded portions, wherein at least one of the threads is a shearable thread, wherein the ogive element is reversibly engaged with the fuze and main body; and a frangible link that retains the ogive element and main body in operable arrangement, such that upon an impact, said frangible link is caused to fail, and such that said shearable thread has a lower shear strength than the frangible link to allow for the shearable thread to fail during flight of the common carrier munition.

16. The common carrier shell according to claim 15, wherein the main body comprises a threaded portion manufactured from a first material, and the tail unit comprises a threaded portion manufactured from second material, wherein the second material has a lower hardness value than the first material.

17. The common carrier shell according to claim 15, wherein the ogive element has a forward end locatable with said fuze and an aft end locatable with said main body, wherein the internal diameter of the aft end of said ogive element is substantially the same as the internal diameter of said payload cavity.

18. The common carrier shell according to claim 15, wherein the ogive element is reversibly engaged with the fuze and main body.

19. The common carrier shell according to claim 15, wherein the fuze is operably connected to at least one expulsion charge, wherein said charge is suspended in free space.

* * * * *